US007730880B1

(12) United States Patent
Nagai et al.

(10) Patent No.: US 7,730,880 B1
(45) Date of Patent: Jun. 8, 2010

(54) IGNITION APPARATUS FOR INTERNAL COMBUSTION ENGINE

(75) Inventors: Takayoshi Nagai, Tokyo (JP); Hirohisa Kuwano, Tokyo (JP); Ikuro Suga, Tokyo (JP); Yusuke Naruse, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 12/571,964

(22) Filed: Oct. 1, 2009

(30) Foreign Application Priority Data

Dec. 16, 2008 (JP) ..... 2008-319884

(51) Int. Cl.
*F02P 3/04* (2006.01)

(52) U.S. Cl. ..... 123/620; 123/598; 123/606; 123/649; 123/655

(58) Field of Classification Search ..... 123/598, 123/606, 620, 649, 650, 655
See application file for complete search history.

(56) References Cited

U.S. PATENT DOCUMENTS 3,357,415 A * 12/1967 Huntzinger ..... 123/604
3,461,345 A * 8/1969 Gilbert ..... 315/209 R
3,565,048 A * 2/1971 Monpetit ..... 123/604
4,327,701 A * 5/1982 Gerry ..... 123/598
4,922,883 A * 5/1990 Iwasaki ..... 123/598
7,404,396 B2 * 7/2008 Toriyama et al. ..... 123/598

FOREIGN PATENT DOCUMENTS

JP 2007-211631 8/2007

* cited by examiner

*Primary Examiner*—Erick Solis
(74) *Attorney, Agent, or Firm*—Oblon, Spivak, McClelland, Maier & Neustadt, L.L.P.

(57) ABSTRACT

There is obtained an ignition apparatus, for an internal combustion engine, that can make a predetermined output current flow in a stable manner so that the combustion state of the internal combustion engine can always be maintained in a good condition, even in the case where the voltage of the power source connected with the energy storing coil fluctuates. There are provided an energy storing coil (3), a switching means (S1) for accumulating energy, an ignition coil (4), and a switching means (S2) that turns on/off an ignition current; the switching means (S1) and (S2) are alternately turned on/off so that a current with a alternating polarity is made to flow continuously in the ignition coil (6); a switching means (S3) is connected both terminals of the energy storing coil (3); and when a current flowing in the energy storing coil (3) reaches a target value, the switching means (S1) is turned off and the switching means (S3) is turned off so that the energy storing coil current circulates through the switching means (S3) so as to keep the current to be approximately the target value.

8 Claims, 10 Drawing Sheets

IGNITION APPARATUS FOR INTERNAL COMBUSTION ENGINE

BACKGROUND OF THE INVENTION

1. Field of the Invention

The present invention relates to an ignition apparatus for an internal combustion engine and particularly to an ignition apparatus, for an internal combustion engine, that makes a pulse current with an alternating polarity recurrently flow so as to increase ignition energy.

2. Description of the Related Art

In a spark-ignition internal combustion engine, an ignition apparatus configured with an ignition coil and the like produces an ignition discharge between the electrodes of an ignition plug, and due to the ignition discharge, a fuel introduced into a combustion chamber is burned. There is proposed a multiple-discharge ignition apparatus in which, in order to obtain a preferable combustion state of the internal combustion engine, a plurality of ignition discharges is produced between the electrodes of an ignition plug during a single combustion stroke.

For example, an ignition apparatus is configured in such a way that there are provided an energy storing coil connected in series with a DC power source and a first switching means connected in series with the energy storing coil, the energy storing coil and a second switching means are connected with the primary coil of an ignition coil, and an ignition plug is connected with the secondary coil of the ignition coil. Additionally, there is proposed an ignition control apparatus, for an internal combustion engine, in which the first and second switching means are alternately turned on/off so that charging and discharging of the energy storing coil are recurrently carried out, and through the charging and discharging, a current with a positive-negative alternating polarity is recurrently made to flow in the secondary coil of the ignition coil so that multiple discharge is performed (for example, Japanese Patent Application Laid-Open No. 2007-211631 (claims and FIG. 1).

However, in an ignition apparatus for an internal combustion engine proposed in Japanese Patent Application Laid-Open No. 2007-211631 (claims and FIG. 1), there has been a problem that a desired current cannot stably flow in the ignition plug, depending on the voltage of a DC power source connected in series with the energy storing coil, whereby erosion on the ignition plug is caused or ignition operation becomes unstable.

SUMMARY OF THE INVENTION

The present invention has been implemented in order to solve the foregoing problems; the objective thereof is to obtain an ignition apparatus, for an internal combustion engine, that can make a predetermined output current flow in a stable manner so that the combustion state of the internal combustion engine can always be maintained in a good condition, even in the case where the voltage of the power source connected with the energy storing coil fluctuates.

An ignition apparatus for an internal combustion engine according to the present invention is provided with an energy storing coil one terminal of which is connected with a power source; a first switching means connected with the other terminal of the energy storing coil; an ignition coil one terminal of a primary winding of which is connected with the other terminal of the energy storing coil via a diode and a secondary winding of which is connected with an ignition plug; a second switching means connected with the other terminal of the primary winding of the ignition coil; a bypass means that is connected between both terminals of the energy storing coil and has a third switching means; and a control means that controls the first switching means, the second switching means, and the third switching means. The foregoing control means performs control in which the second switching means is recurrently turned on/off in order to apply a current with a positive-negative alternating polarity to the ignition plug, and during an off period of the second switching means, there exist a period in which the first switching means is turned on, thereby making a current flow in the energy storing coil so that energy is stored in the energy storing coil and a period in which the first switching means is turned off and the third switching means is turned on so that a current flowing in the energy storing coil is made to circulate in the bypass means.

In an ignition apparatus for an internal combustion engine according to the present invention, it is made possible to make a predetermined output current flow in a stable manner so that, without accelerating erosion of the ignition plug and unnecessarily dissipating energy, the combustion state of the internal combustion engine can always be maintained in a good condition, even in the case where the voltage of the power source connected with the energy storing coil fluctuates.

The foregoing and other object, features, aspects, and advantages of the present invention will become more apparent from the following detailed description of the present invention when taken in conjunction with the accompanying drawings.

DETAILED DESCRIPTION OF THE PREFERRED EMBODIMENTS

Preferred embodiments of an ignition apparatus for an internal combustion engine according to the present invention will be explained below, with reference to the accompanying drawings. In addition, the invention is not limited to the embodiments.

Embodiment 1

Figure 1:
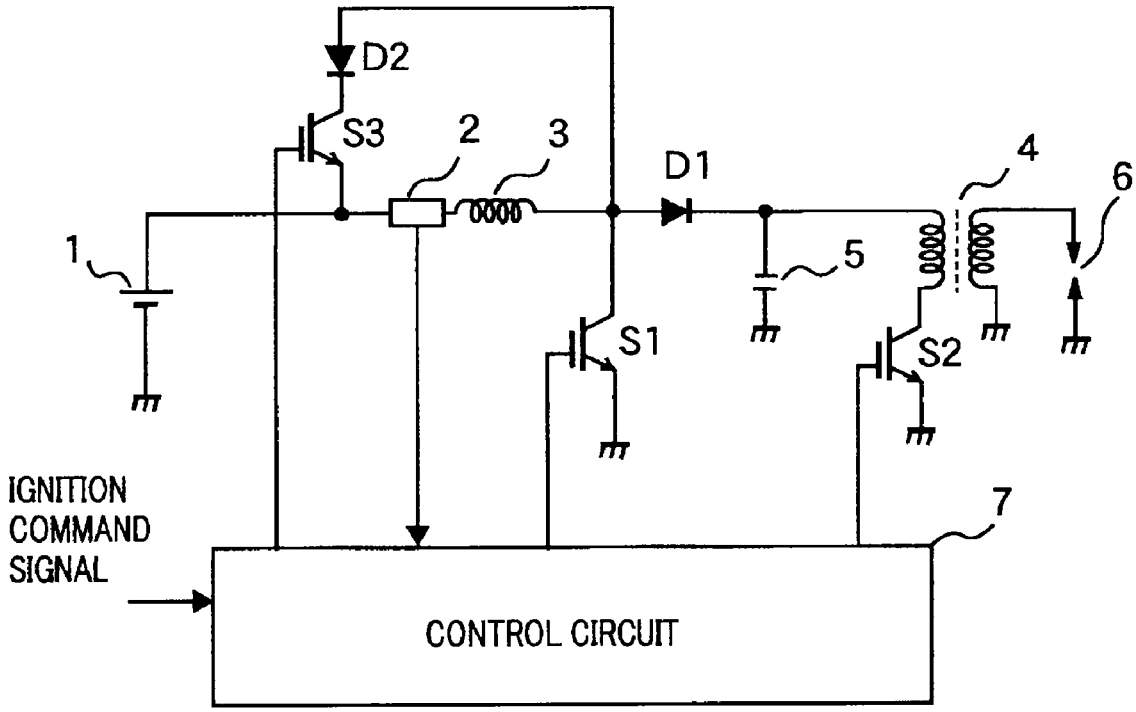
FIG. 1 is a diagram illustrating the configuration of an ignition apparatus for an internal combustion engine according to Embodiment 1 of the present invention.

FIG. 1 is a diagram illustrating the configuration of an ignition apparatus for an internal combustion engine according to Embodiment 1 of the present invention. In FIG. 1, one terminal of an energy storing coil 3 is connected with a DC voltage source 1 such as a battery or a DC-to-DC converter via a current detection means 2. A switching means S1 as a first switching means is connected with the other terminal of the energy storing coil 3. As the current detection means 2 for detecting a current that flows in the energy storing coil 3, a current transformer or a current detector utilizing a current detection resistor or a hall device can be employed. Alternatively, as the energy storing coil 3, a detection coil may be utilized.

Furthermore, a series circuit consisting of a diode D1, a primary winding of an ignition coil 4, and a switching means S2 as a second switching means is connected with the other terminal of the energy storing coil 3 in such a way as to be in parallel with the switching means S1. A capacitor 5 is connected with a connection point between the diode D1 and the ignition coil 4; an ignition plug 6 is connected with a secondary winding of the ignition coil 4. Furthermore, a series circuit consisting of a diode D2 and a switching means S3 as a third switching means, which is one of the features of the present invention related to Embodiment 1, is connected across the energy storing coil 3. The series circuit consisting of the diode D2 and the switching means S3 forms a reverse-current-blocking switch and is a bypass means having the third switching means. The energy storing coil 3, the diode D2, and the switching means S3 configure a stored current circulation circuit; the operation of the stored current circulation circuit will be described later. In addition, as each of the switching means S1, S2, and S3, an IGBT, a FET, a bipolar transistor, or the like can be utilized.

A control means, for example, a control circuit 7 controls the switching means S1, S2, and S3, based on an ignition command signal inputted from an external circuit such as an electronic control system (ECU) and an energy storing coil current signal outputted from the current detection means 2. The ignition command signal is formed by use of a plurality of signal lines and consists of an ignition preparation signal and an ignition period signal described later. Alternatively, the foregoing signals may be integrated so as to be transmitted through a single signal line.

The ignition apparatus for an internal combustion engine according to Embodiment 1 is configured as described above. Next, the basic operation of each unit will be explained.

In the configuration illustrated in FIG. 1, when the switching means S1 is turned on, the voltage of the DC voltage source 1 is applied across the energy storing coil 3 via the switching means S1, and a current in the energy storing coil 3 gradually increases. In other words, energy is gradually stored in the energy storing coil 3.

As described later, the capacitor 5 is charged with a current outputted from the energy storing coil 3. When, under the condition that the capacitor 5 is charged, the switching means S2 is turned on, a high voltage is applied across the ignition plug 6 due to a voltage-boost effect of the ignition coil 4. For example, in the case where the voltage across the capacitor 5 is 300 V and the turn ratio Nr (=Ns/Np) is 100 (where Np is the number of turns of the primary winding of the ignition coil 4, and Ns is the number of turns of the secondary winding), a voltage of 30 kV is generated across the secondary winding of the ignition coil 4. In practice, due to LC resonance produced by a leakage inductance and a stray static capacity of the ignition coil 4, a higher voltage of 35 kV to 40 kV is instantaneously applied to the ignition plug 6. An ignition discharge can be started between the electrodes of the ignition plug 6, by utilizing the foregoing voltage.

When, under the condition that a predetermined current is applied to the energy storing coil 3, the switching means S1 and S3 are turned off and the switching means S2 is turned on, a current represented by Equation 1 below can be applied to the ignition plug 6.

$$\{(\text{current in energy storing coil 3})-(\text{primary magnetizing current in ignition coil 4})\}/Nr \quad \text{(Equation 1)}$$

It is possible to regard the energy storing coil 3 as a constant current source whose current value gradually changes, and the primary magnetizing current in the ignition coil 4 also gradually increases depending on the primary inductance and the primary voltage; therefore, a predetermined current that gradually decreases can be made to flow in the ignition plug 6, regardless of the discharge impedance. In other words, this circuit has a constant current output characteristic. After the start of discharge, the ignition plug 6 demonstrates a constant voltage characteristic of approximately 1 kV; therefore, in order to control electric power applied to the ignition plug 6, a constant current characteristic of this kind is required at the circuit side.

When, under the condition that an magnetizing current is applied to the ignition coil 4, the switching means S2 is turned off, a current caused by the magnetizing current can be applied to the ignition plug 6, due to a so-called flyback operation. In this case, the current value is the secondary equivalent value of the magnetizing current, i.e., a value represented by Equation 2 below.

$$(\text{primary magnetizing current in ignition coil 4})/Nr \quad \text{(Equation 2)}$$

Next, there will be explained the stored current circulation circuit, which is one of the features of the present invention related to Embodiment 1. When, under the condition that a current is applied to the energy storing coil 3, the switching means S1 and S2 are turned off and the switching means S3 is turned on, the current outputted from the energy storing coil 3 flows in the loop that passes through the diode D2 and the switching means S3, and returns to the energy storing coil 3. The voltage drop in the current path is only a small voltage drop that consists of an on-voltage of the switching means S3, the forward voltage of the diode D2, and the voltage drops due to the winding resistance of the energy storing coil 3 and the lead-wire resistance. Accordingly, the current in the energy storing coil 3 continues to flow almost without changing; thus, the energy stored in the energy storing coil 3 can be maintained. It is referred to as "circulating a coil current" to make the current path that passes through the energy storing coil 3 include neither a power source nor a load so that, as described above, only a parasitic voltage drop is caused (ideally, no voltage drop), thereby maintaining a current that flows in the energy storing coil 3.

Figure 2:
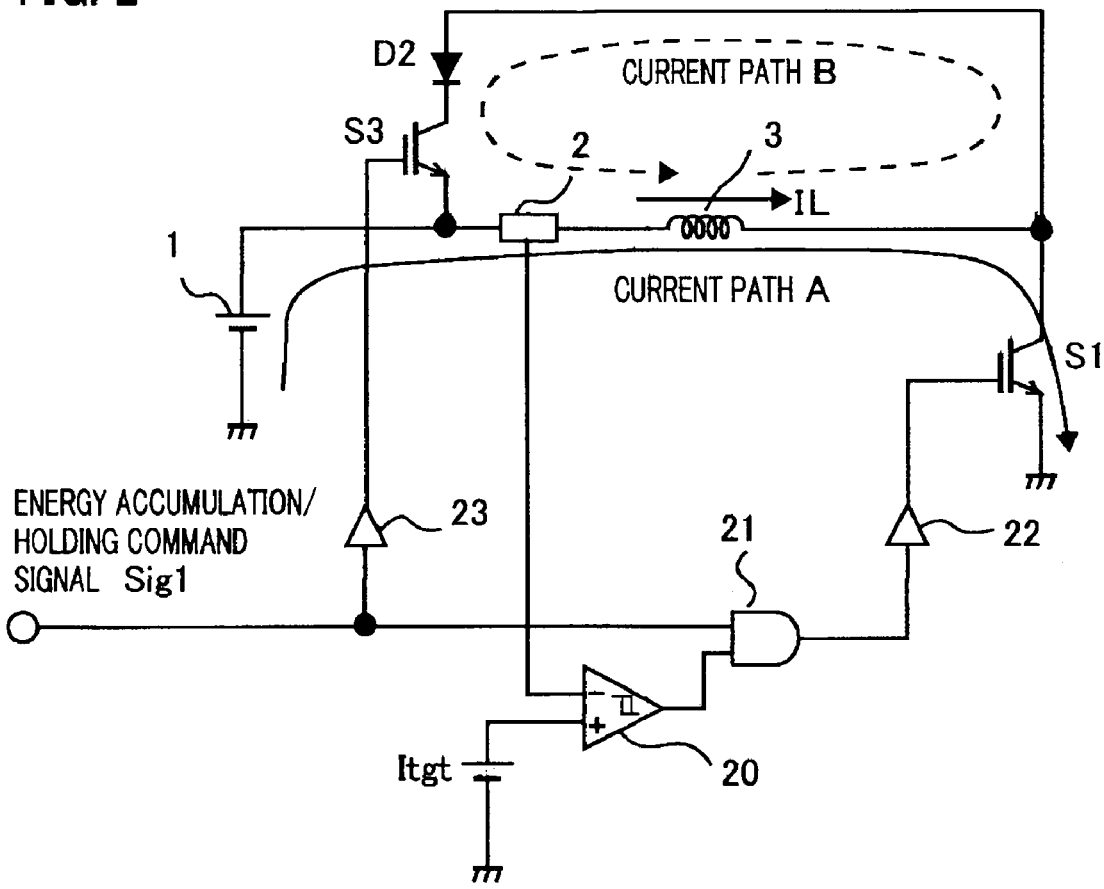
FIG. 2 is a diagram illustrating a circuit, in an ignition apparatus for an internal combustion engine according to Embodiment 1 of the present invention, that maintains an energy storing coil current to be approximately a predetermined target value, by circulating a coil current.

FIG. 2 is a diagram illustrating the peripheral circuits of the energy storing coil 3 and part of the control circuit 7 in FIG. 1; FIG. 2 is a diagram illustrating a circuit that maintains a current in the energy storing coil 3 to be approximately a predetermined target value, by circulating a coil current.

A current signal detected by the current detection means 2 is compared with a target current value Itgt by a hysteresis comparator 20 (in practice, a detected current is converted into a voltage and is compared with a voltage obtained through conversion of the target current value; however, in this embodiment, the explanation will be carried out assuming that the current value is directly compared with the target current value).

Letting Ihp and Ihm denote the positive hysteresis width and the negative hysteresis width of the hysteresis comparator 20, respectively, the output of the hysteresis comparator 20 becomes L-level when the detected current value rises up to Itgt+Ihp; the output of the hysteresis comparator 20 becomes H-level when the detected current value drops down to Itgt−Ihm.

An AND circuit 21 makes the logical multiplication of the output of the hysteresis comparator 20 and an energy storing/holding command signal Sig1, and then on-off control of switching means S1 is performed via a gate driver 22. The energy storing/holding command signal Sig1 is directly utilized, and on-off control of the switching means S3 is performed via a gate driver 23. It is assumed that the switching means S1 and S3 are turned on when the respective input levels of the gate drivers 22 and 23 are H-level.

Figure 3:
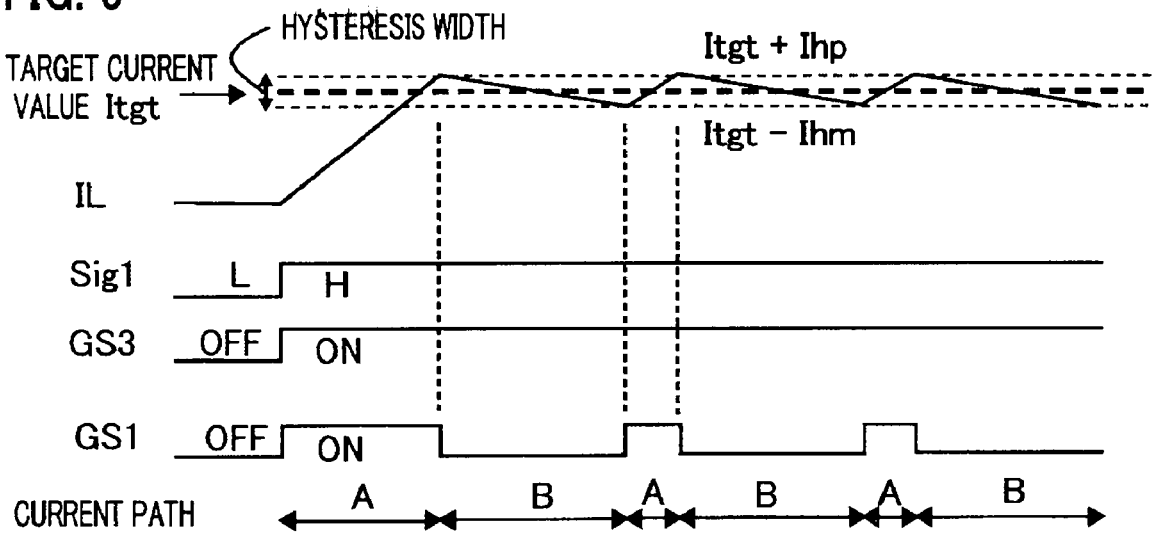
FIG. 3 is a timing chart for explaining operation, in an ignition apparatus for an internal combustion engine according to Embodiment 1 of the present invention, that maintains an energy storing coil current to be approximately a predetermined target value, by circulating a coil current.

FIG. 3 is a timing chart representing the operation of the circuit illustrated in FIG. 2. In FIG. 3, IL indicates the waveform of a current that flows in the energy storing coil 3; GS1 and GS3 indicate the on/off states of the switching means S1 and S3, respectively.

When the energy storing/holding command signal Sig1 becomes active (H-level), the switching means S1 and S3 are concurrently turned on; then, a current flows in the current path A indicated in FIG. 2, and hence the current in the energy storing coil 3 gradually increases. When the current value reaches Itgt+Ihp, the output level of the hysteresis comparator 20 becomes L-level; the switching means S1 is turned off; then, the current in the energy storing coil 3 circulates in the current path B. When, due to a slight voltage drop in the circulation path, the current gradually decreases to Itgt−Ihm, the output of the hysteresis comparator 20 becomes H-level, whereby the switching means S1 is turned on again.

The foregoing operation is repeated, so that the energy storing coil current is kept to be an almost constant value (from Itgt−Ihm to Itgt+Ihp) in the vicinity of the target current value. In the foregoing operation, there has been explained that, during the on-period of the switching means S1, the switching means is kept off; however, the switching means S3 may be either turned on or turned off during the on-period of the switching means S1.

Next, with reference to FIG. 1, there will be explained, based on FIG. 4, the operational sequence of the overall ignition operation performed by the ignition apparatus for an internal combustion engine according to Embodiment 1.

Figure 4:
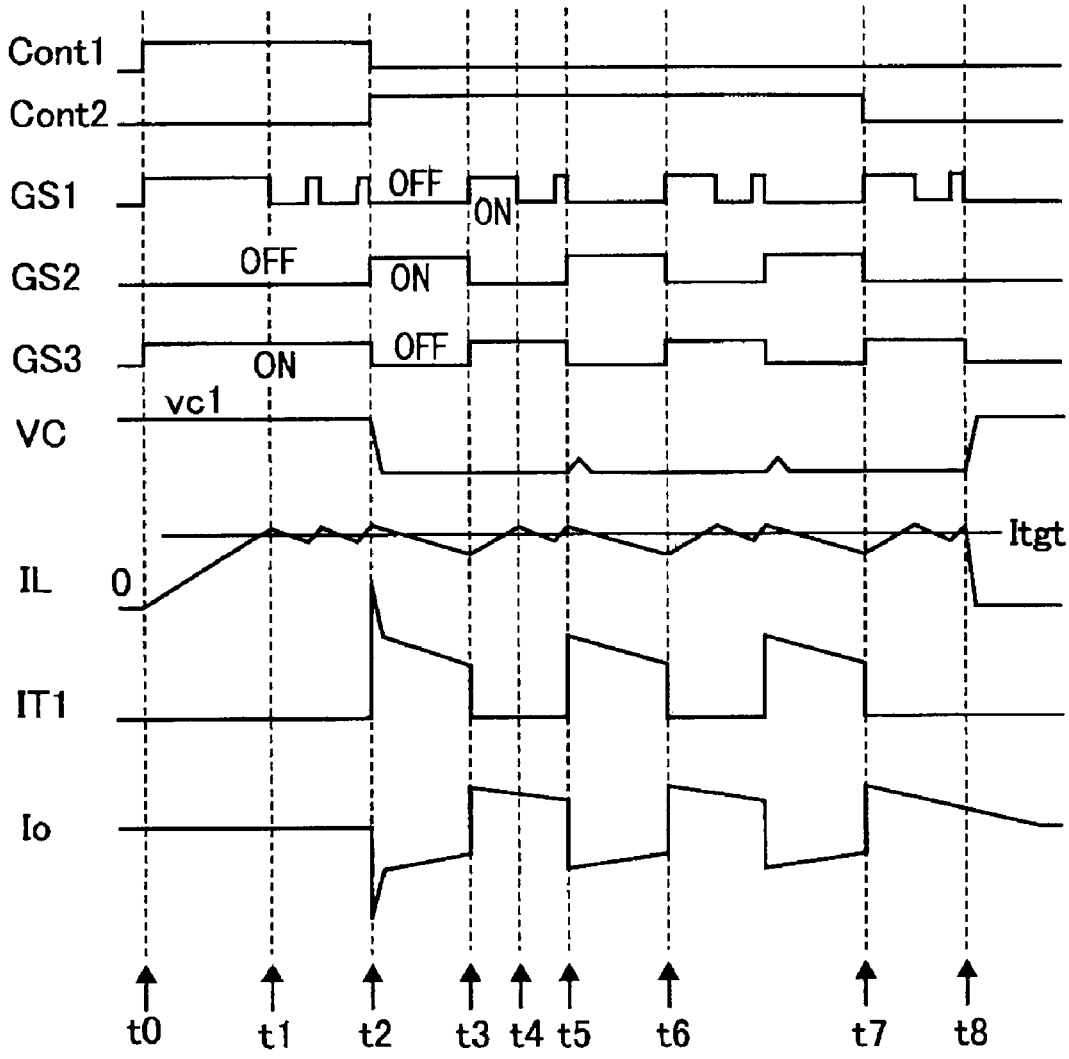
FIG. 4 is a timing chart representing overall operation sequence in an ignition apparatus for an internal combustion engine according to Embodiment 1 of the present invention.

In FIG. 4, each of an ignition preparation signal Cont1 and an ignition period signal Cont2 is a digital signal that is part of the ignition command signal in FIG. 1. GS1, GS2, and GS3 indicate the on/off states of the switching means S1, S2, and S3, respectively. IL, LT1, and Io indicate the current in the energy storing coil 3, the primary current of the ignition coil 4, and the current in the ignition plug 6, respectively. VC indicates the voltage across the capacitor 5; as an initial state, a voltage vc1 is stored across the capacitor 5. The voltage vc1 is, for example, 300 V.

When, at a time t0, the ignition preparation signal Cont1 rises, the switching means S1 and S3 are turned on; thus, the current IL in the energy storing coil 3 increases and energy is stored therein. When, at a time t1, the current IL in the energy storing coil 3 reaches (Itgt+Ihp), the switching means S1 is turned off, and the current IL in the energy storing coil 3 circulates. After that, by alternating energy storing and circulating until a time t2 in accordance with the method that has been explained with reference to FIGS. 2 and 3, the current IL in the energy storing coil 3 is kept to be an almost constant value.

When, at the time t2, the ignition preparation signal Cont1 falls and the ignition period signal Cont2 rises, the switching means S1 and S3 are turned off and the switching means S2 is turned on; therefore, the voltage vc1 across the capacitor 5 is applied to the primary winding of the ignition coil 4 and then stepped up by the ignition coil 4 to 30 kV to kV, so that the ignition plug 6 starts an ignition discharge.

Then, the current IL, which has been flowing in the energy storing coil 3, flows into the primary winding of the ignition coil 4, whereby the magnetizing current energy is stored in the ignition coil 4 and the current Io flows in the ignition plug 6. After the start of the ignition discharge, the discharge characteristic demonstrates a constant voltage characteristic of approximately 1 kV between the electrodes of the ignition plug 6; however, due to the constant-current output characteristic of this circuit, it is made possible to make a predetermined current that gradually decreases flow in the ignition plug 6.

During the period from the time t2 to a time t3, the energy stored in the energy storing coil 3 released, and the current IL in the energy storing coil 3 gradually decreases. Part of the released energy is utilized as the discharging energy for the ignition plug 6; part of the released energy is stored as the magnetizing energy for the ignition plug 6; part of the released energy is dissipated by parasitic resistance components of the circuit.

At the time t3, the switching means S1 and S3 are turned on and the switching means S2 is turned off, so that energy is stored in the energy storing coil 3. In this situation, because the primary current IT1 of the ignition coil 4 is interrupted, the magnetizing current that has been flowing in the ignition coil 4 is outputted through the secondary winding of the ignition coil 4; thus, in the ignition plug 6, there flows the current Io having a polarity opposite to that of the current Io that has been flowing during the period between the time t2 and the time t3. The time t3 may be determined by making the time period between the time t2 and the time t3 to be a predetermined time period that is preliminarily determined, or by detecting the current Io of the ignition plug 6, a time at which the current Io falls to a predetermined value may be adopted as the time t3. When the current IL in the energy storing coil 3 increases and returns approximately up to the target value at a time t4, the circulation operation is performed, so that the energy storing coil current is maintained. As described above, the control is performed in such a way that, during the off period of the switching means S2, the control means 7 has a period in which the switching means S1 is turned on and hence a current is made to flow in the energy storing coil 3 so that energy is stored in the energy storing coil 3 and a period in which the switching means S1 is turned off and the switching means s3 is turned on so that the current flowing in the energy storing coil 3 is made to circulate in the bypass means.

As is the case with the period from the time t2 to the time t3, during the period from a time t5 to a time t6, the switching means S1 and S3 are turned off and the switching means S2 is turned on. The current IL, which has been flowing in the energy storing coil 3, flows into the primary winding of the ignition coil 4, whereby the magnetizing current energy is stored in the ignition coil 4 and the current Io flows in the ignition plug 6. However, because the electric charge on the capacitor 5 has been discharged; thus, unlike the period between the time t2 and the time t3, no high voltage is applied to the ignition plug 6.

Here, paying attention to the operation of the energy storing coil 3, the period from the time t3 to the time t5 is referred to as an "energy storing period" because, during that period, energy is stored in the energy storing coil 3. In contrast, the period from the time t5 to the time t6 is referred to as an "energy releasing period" because, during that period, energy is released from the energy storing coil 3.

Additionally, paying attention to the operation of the ignition coil 4, the period from the time t3 to the time t5 is referred to as a "flyback period" because, during that period, operation for outputting the magnetizing current of the ignition coil 4, i.e. so-called flyback operation is performed. In contrast, the period from the time t5 to the time t6 is referred to as a "forward period" because, during that period, there is performed operation in which, by making a current flow in the primary winding of the ignition coil 4, an output is obtained from the secondary winding of the ignition coil 4 and the magnetizing current is increased, i.e., so-called forward operation.

After that, the operation that is the same as that performed during the period from the time t3 to the time t6 is repeated twice or more times, so that the current Io with a alternating polarity can be made to flow in the ignition plug 6. In other words, by performing control in which the switching means S2 is recurrently turned on/off, a current with a positive-negative alternating polarity can be applied to the ignition plug 6.

When, at a time t7, the ignition period signal Cont2 falls and hence the end of the recurrent operation is commanded, the switching means S1, S2, and S3 are all turned off at a time t8 when the energy storing period is to end. After that, the output current IL of the energy storing coil 3 flows into the capacitor 5; the capacitor 5 is charged to a value that is the same as the initial value; then, a series of operations is completed.

In the foregoing operation, as described above, the period from the time t3 to the time t5 is an energy storing period when attention is paid to the operation of the energy storing coil 3; however, paying attention to the operation of the ignition coil 4, the period from the time t3 to the time t5 is a flyback period. In other words, in the same period, different operations are performed at different portions of the circuit. It is not possible to extend or shorten only one of the operation periods.

Similarly, the period from the time t5 to the time t6 is an energy release period and a flyback period; it is not possible, either, that only one of the periods is independently varied.

In a conventional method in which no switching means S3 is provided and no circulation operation is performed, due to the foregoing restriction, it is not possible to optimally maintain all the operations. The foregoing problem will be explained with reference to FIGS. 5 and 6.

Figure 5:
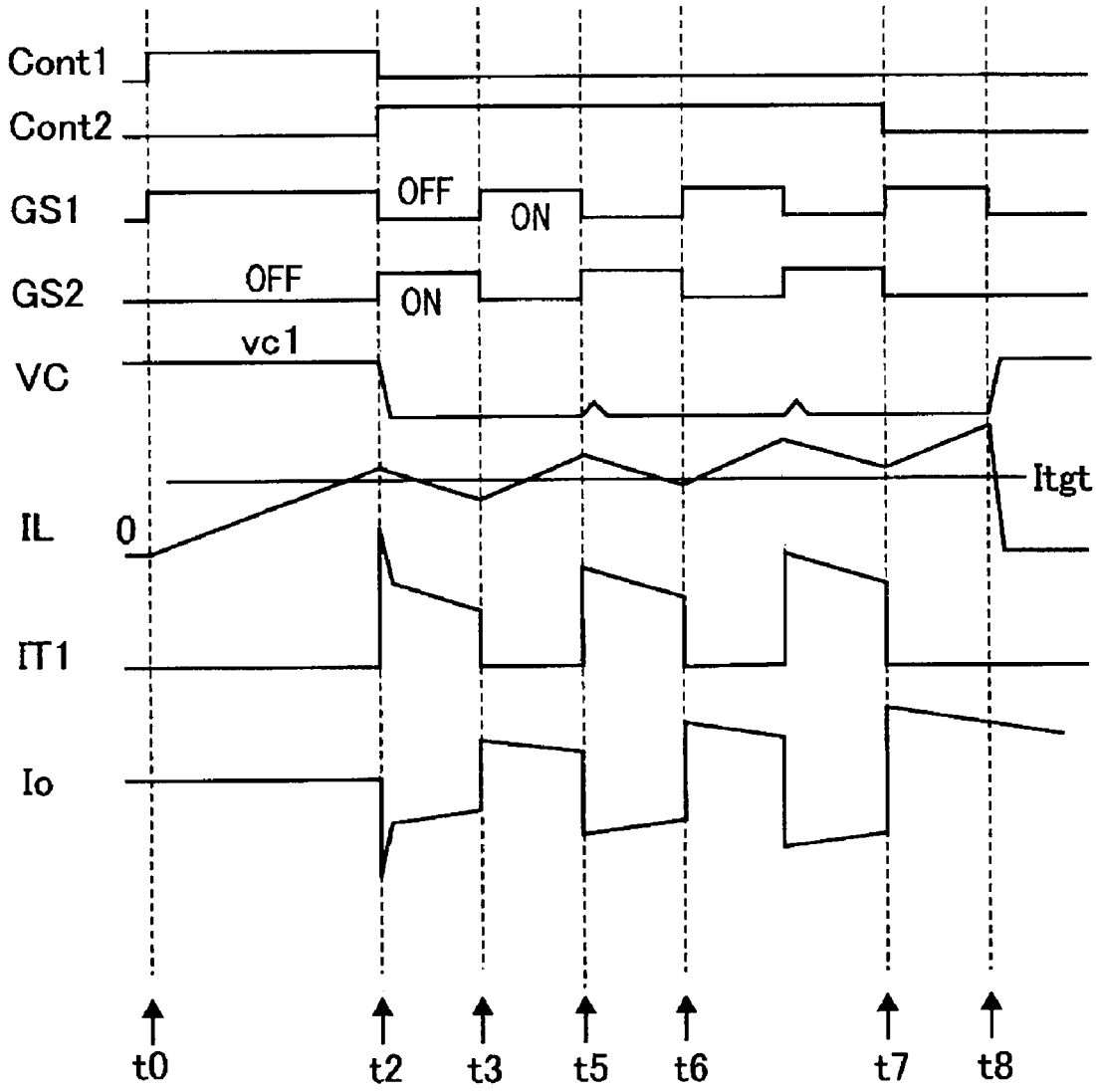
FIG. 5 is a timing chart for explaining operation in a conventional multiple ignition method, in the case where an input voltage is high.
Figure 6:
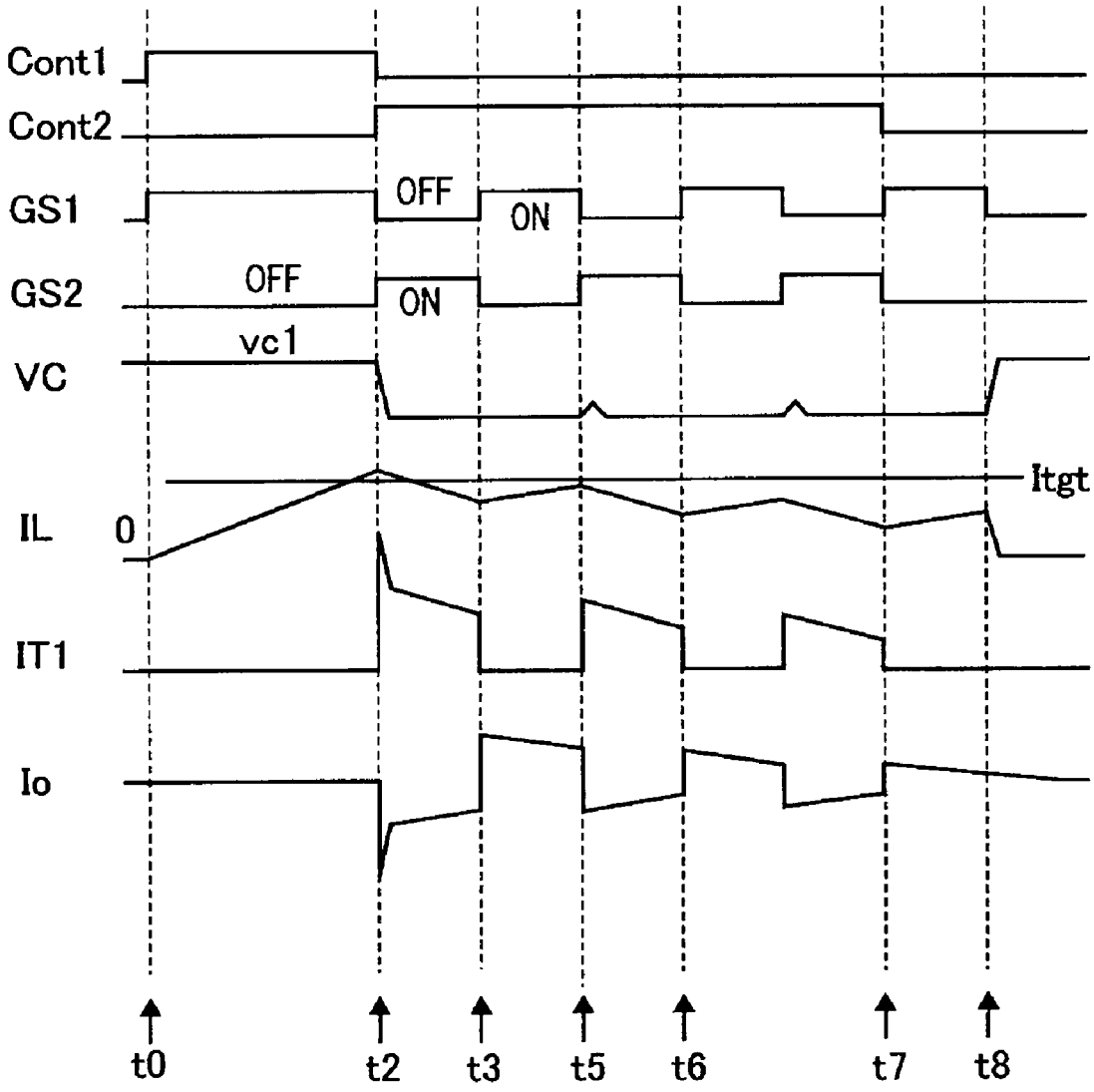
FIG. 6 is a timing chart for explaining operation in a conventional multiple ignition method, in the case where an input voltage is low.

FIGS. 5 and 6 are timing charts each representing the operation sequence of a conventional multiple ignition method. FIG. 5 is the timing chart in the case where the voltage of the input DC voltage source is high; FIG. 6 is the timing chart in the case where the voltage of the input DC voltage source is low.

In the case where attention is paid to the operation of the ignition coil 4 during a recurrent period, in order to keep the ignition plug current in the forward period approximately equal to the ignition plug current in the flyback period, it is required to keep the increase width of the magnetizing current in the forward period approximately equal to the decrease width of the magnetizing current in the flyback period. Because, due to the constant voltage characteristic of the ignition plug 6, the voltage applied to the ignition coil 4 is kept constant regardless of its polarity, the absolute value $|di/dt|$ of the increase or decrease speed of the magnetizing current is constant; therefore, in order to keep the increase width of the magnetizing current approximately equal to the decrease width thereof, it is required to make the time width of the forward period equal to that of the flyback period.

On the other hand, paying attention to the energy storing coil 3, the decrease speed of a current during the energy release period depends on the energy release amount, i.e., the output power; therefore, when it is assumed that the output power is constant, the decrease speed of a current is constant. However, the increase speed of a current during the energy storing period depends on the input voltage; therefore, when the input voltage is high, the increase speed becomes high, and when the input voltage is low, the increase speed becomes low. Accordingly, in the case where the forward period and the flyback period are set to the same time width, when the input voltage is high, the storing coil current gradually increases, and the output current also increases, as represented in FIG. 5.

When the input voltage is low, the storing coil current gradually decreases, and the output current also decreases, as represented in FIG. 6. As described above, in a conventional method, the output current gradually increases or decreases depending on the input voltage; thus, the output current cannot be kept constant. Accordingly, there has been a problem that excessive increase in the output current causes energy for ignition to be unnecessarily dissipated and accelerates erosion on the electrodes of the ignition plug 6, thereby shortening the lifetime of the ignition plug 6. Additionally, when the output current decreases, necessary ignition energy cannot be obtained, which leads to ignition failure.

In an ignition apparatus for an internal combustion engine according to Embodiment 1, as represented in FIG. 4, the two operations, i.e., the energy storing operation and the energy circulation operation are performed during the energy storing period, so that it is made possible to keep the current in the storing coil 3 to be a predetermined value regardless of the value of the input voltage. As a result, it is possible to keep the output current for the ignition plug 6 to be a predetermined value; therefore, there can securely be performed ignition that extends the lifetime of the ignition plug 6 and dissipates no unnecessary energy.

Embodiment 2

Next, an ignition apparatus for an internal combustion engine according to Embodiment 2 of the present invention will be explained. In Embodiment 1, it is made possible to keep the current in the storing coil current to be a predetermined value regardless of the value of the input voltage. However, the input-voltage range in which the storing coil current is kept to the predetermined value is limited. In other words, the circulation operation is performed after the coil current reaches the target value; thus, in the case where the input voltage is very low, there may be a case where the coil current does not reach the target value within the energy storing period and hence the storing coil current gradually decreases.

Accordingly, in an ignition apparatus for an internal combustion engine according to Embodiment 2, an intermediate outgoing line (intermediate tap) is provided in the energy storing coil and the switching means S1 is connected with the intermediate tap, so that the increase speed of a current during the energy storing period is accelerated.

Figure 7:
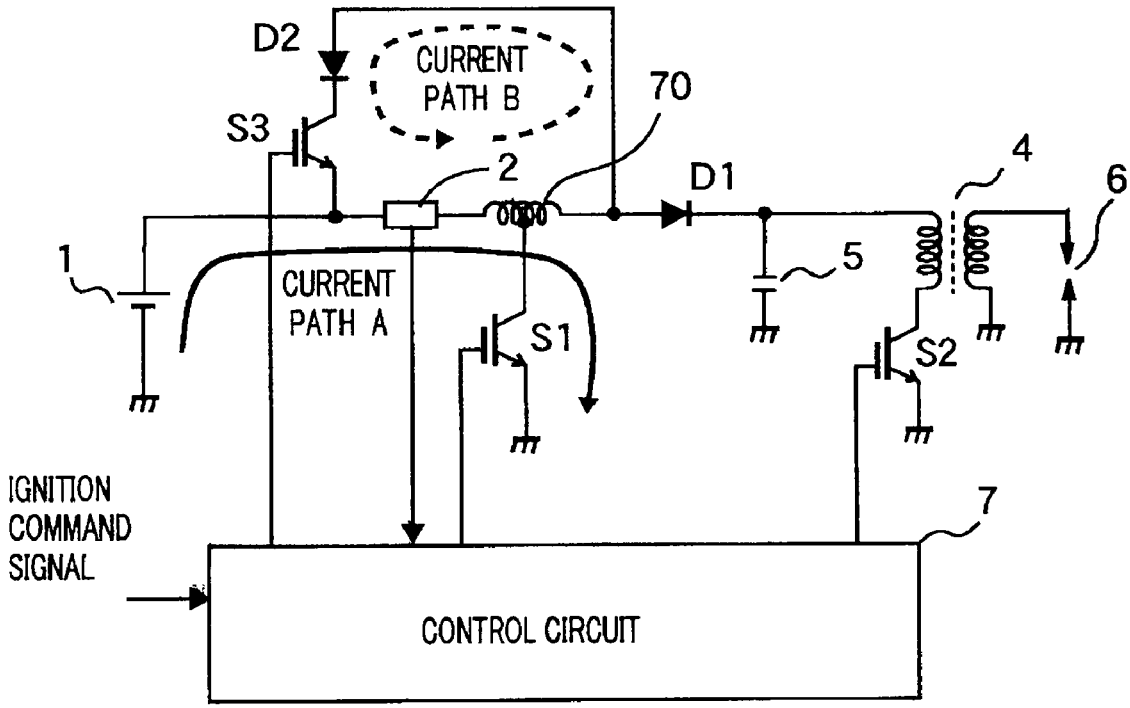
FIG. 7 is a diagram illustrating the configuration of an ignition apparatus for an internal combustion engine according to Embodiment 2 of the present invention.

FIG. 7 is a diagram illustrating the configuration of an ignition apparatus for an internal combustion engine according to Embodiment 2. The only difference between Embodiment 1 and Embodiment 2 is that the switching means S1 is connected with the intermediate tap of an energy storing coil 70; the other configurations of Embodiment 2 are the same as those of Embodiment 1. Accordingly, the current path during the energy storing operation becomes a path indicated by "current path A" in FIG. 7.

In this situation, letting Ne, Ne1, and Le denote the total number of turns of the energy storing coil 70, the number of turns of the portion, of the energy storing coil 70, from the input (at the power source side) to the intermediate tap, and the total inductance, respectively, an inductance Le1 of the portion, of the energy storing coil 70, from the input to the intermediate tap is given by Equation 3 below.

$$Le1=Le\times(Ne1/Ne)^2 \quad \text{(Equation 3)}$$

Figure 8:
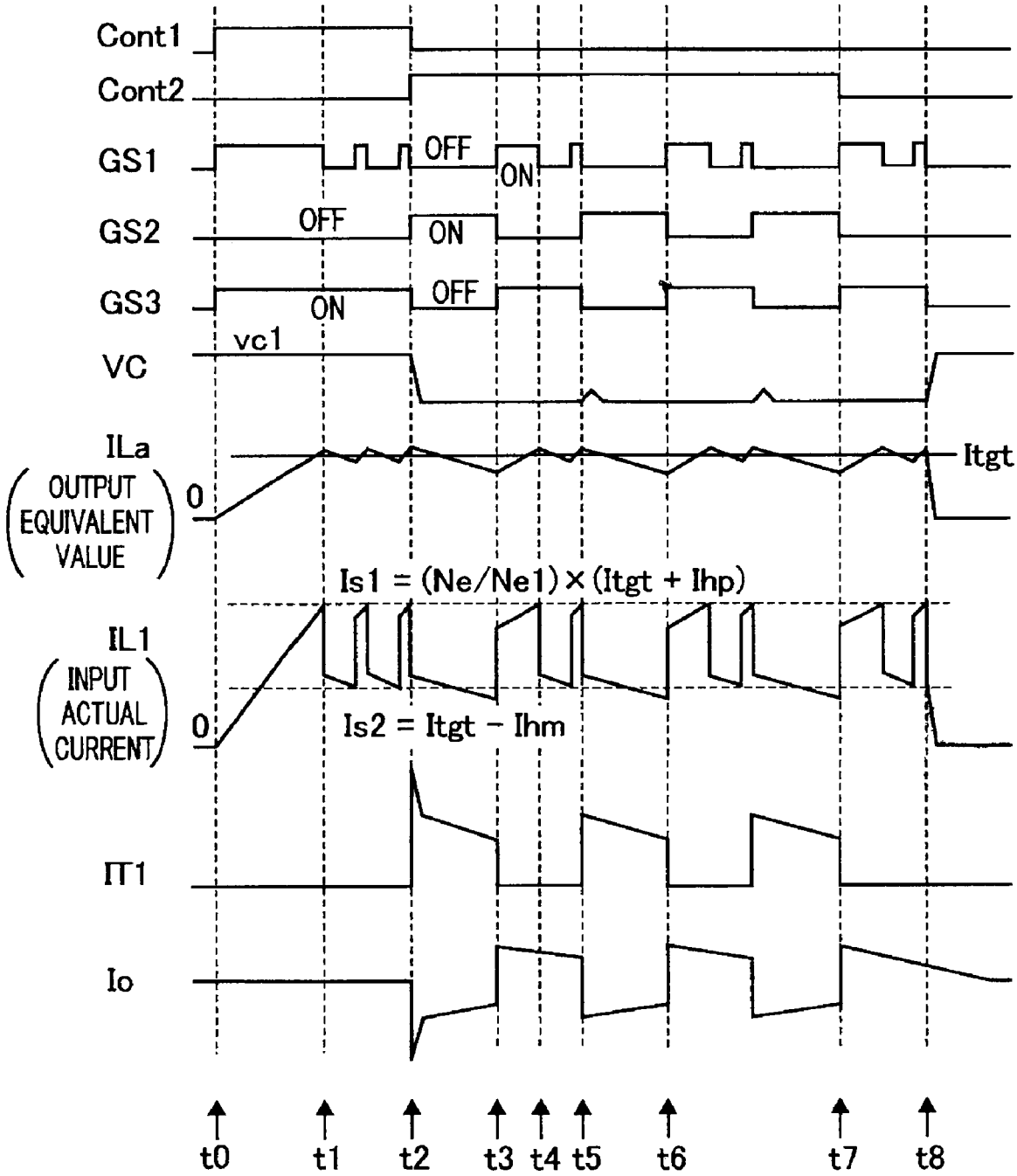
FIG. 8 is a timing chart representing overall operation sequence in an ignition apparatus for an internal combustion engine according to Embodiment 2 of the present invention.

FIG. 8 is a timing chart representing the operation sequence of the overall operation performed by an ignition apparatus for an internal combustion engine according to Embodiment 2. In FIG. 8, IL1 denotes a current that flows into the input of the energy storing coil 70 and is detected by the current detection means 2. ILa denotes the output equivalent value of a current that flows through the energy storing coil 70 and is given by Equation 4 below in the case where a current flows in the current path A indicated in FIG. 7.

$$ILa=(Ne1/Ne)\times IL1 \quad \text{(Equation 4)}$$

When, at a time to, the ignition preparation signal Cont1 rises, the switching means S1 and S3 are turned on; thus, the current IL1 that flows into the energy storing coil 70 increases. In order to make the target current Itgt flow in the current path B in FIG. 7, it is required, from Equation 4, to preliminarily make a current given by Equation 5 below flow in the current path A.

$$IL1=(Ne/Ne1)\times Itgt \quad \text{(Equation 5)}$$

Thus, a first detection level of a hysteresis comparator (unillustrated) is set to a value given by Equation 6 below, and when the input current reaches this value, the circulation operation is started.

$$Is1=(Ne/Ne1)\times(Itgt+Ihp) \quad \text{(Equation 6)}$$

where Ihp is the positive hysteresis width of the hysteresis comparator.

When the circulation operation is started, the current path A is replaced by the current path B, and the input current value rapidly becomes a value (It2+Ihp) that is the same as the value of the output equivalent current; after that, the input current gradually decreases. The hysteresis comparator is configured in such a way that a second detection level Is2 thereof is set to a value given by Equation 7 below and when the input current decreases to this value, the switching means S1 is turned on again, so that, as is the case with Embodiment 1, the output equivalent value ILa of the energy storing coil current falls within a constant range from (Itgt−Ihm) to (Itgt+Ihp).

$$Is2=Itgt-Ihm \quad \text{(Equation 7)}$$

When energy is stored in the energy storing coil 70 through the current path A, the gradient d(IL1)/dt of the current is given by Equation 8 below, letting VL denote the voltage applied to the inductance.

$$d(IL1)/dt=VL/Le1=(VL/Le)\times(Ne/Ne1)^2 \quad \text{(Equation 8)}$$

That is to say, the gradient d(IL1)/dt is $(Ne/Ne1)^2$ times as large as the gradient in the case where the voltage VL is applied to the energy storing coil 70 having an inductance Le, without utilizing the intermediate tap. By rewriting the foregoing gradient d(IL1)/dt with respect to the output current value ILa, Equation 9 is yielded.

$$d(ILa)/dt=(Ne1/Ne)\times d(IL1)/dt=(Ne/Ne1)\times VL/Le \quad \text{(Equation 9)}$$

In other words, the output equivalent current value of the energy storing coil current increases at a speed that is (Ne/Ne1) times as fast as the speed in the case where no intermediate tap is utilized. For example, assuming that Ne1 is equal to Ne/2, ILa increases at a gradient that is twice as steep as the gradient in the case where no intermediate tap is utilized, and reaches the target in a time that is half as short as the time in the case where no intermediate tap is utilized.

Accordingly, by providing an intermediate tap in the energy storing coil 70, ILa can reach the target current in a relatively short time, even in the case where the input voltage is very low. In the case where the input voltage is high, the current may be maintained through the circulation operation; therefore, in Embodiment 2, even in a wider input voltage range, the energy storing coil current and the current in the ignition plug 6 can be kept to be predetermined values. In the case where the ignition apparatus according to Embodiment 2 is utilized in an in-vehicle internal combustion engine, the vehicle battery voltage varies in a wide range, for example, of 6 V through 16 V. Even in this case, ignition can stably be performed without making the ignition plug current change.

Embodiment 3

Figure 9:
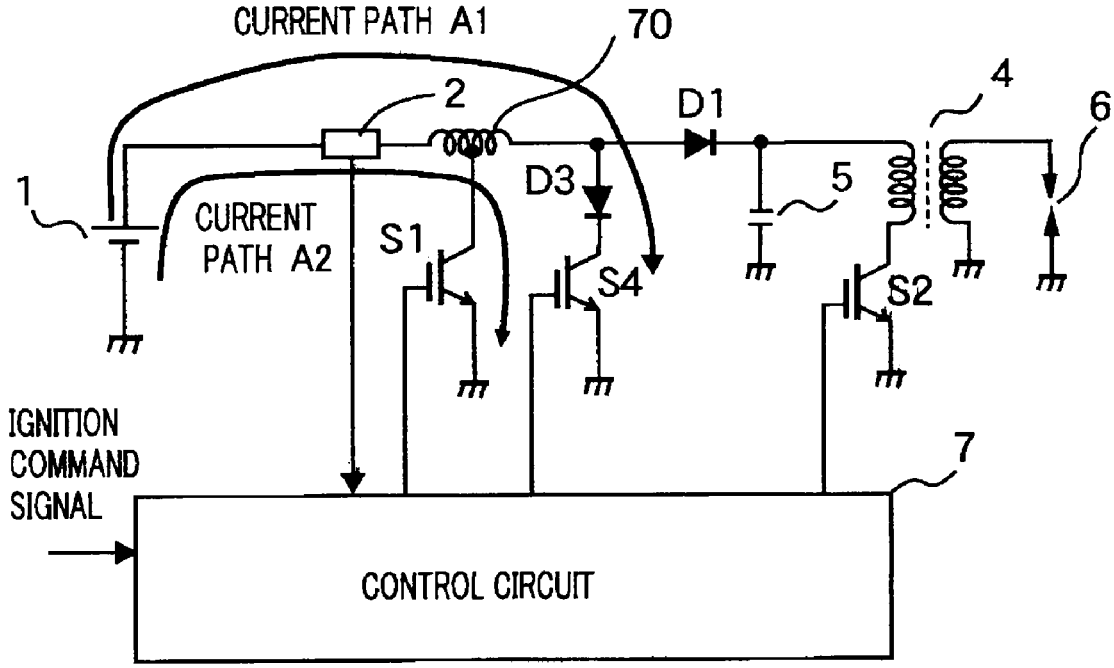
FIG. 9 is a diagram illustrating the configuration of an ignition apparatus for an internal combustion engine according to Embodiment 3 of the present invention.

Next, an ignition apparatus for an internal combustion engine according to Embodiment 3 of the present invention will be explained. FIG. 9 is a diagram illustrating the configuration of an ignition apparatus for an internal combustion engine according to Embodiment 3. As illustrated in FIG. 9, in the ignition apparatus for an internal combustion engine according to Embodiment 3, the switching means S1 is connected with the intermediate outgoing line of the energy storing coil 70, and a series circuit consisting of a switching means S4 as a fourth switching means and a diode D3 is connected with the output terminal of the energy storing coil 70. In addition, with regard to other configurations, constituent elements, of Embodiment 3, that are the same as or equivalent to those in Embodiment 1 or Embodiment 2 are designated by the same reference characters, and the explanation therefor will be omitted.

As explained in Embodiment 2, when the switching means S1 connected with the intermediate outgoing line of the energy storing coil 70 is turned on, the output equivalent current increases at a speed that is Ne/Ne1 times as fast as the speed in the case where the switching means S4 connected with the output terminal of the energy storing coil 70 is turned on.

Accordingly, the energy storing period is composed of a period in which the switching means S1 is turned on and the switching means S4 is turned on or off (in which the coil current rapidly increases, and hence energy to be stored in the energy storing coil 70 is rapidly increased) and a period in which only the switching means S4 is turned on and the switching means S1 is turned off (in which the coil current gradually increases, and hence energy to be stored in the energy storing coil 70 is gradually increased), so that the value of the current to be reached can be adjusted.

Figure 10:
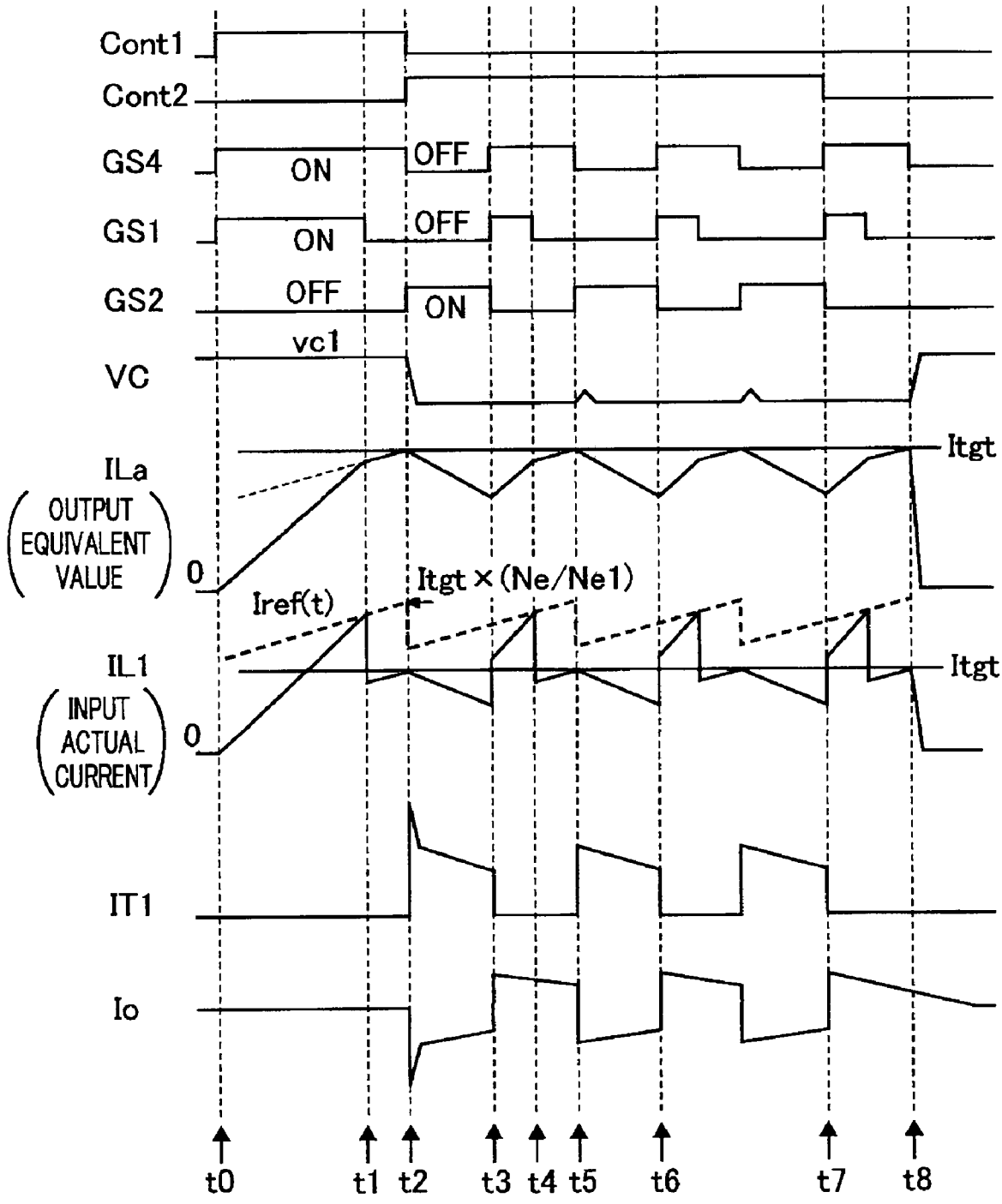
FIG. 10 is a timing chart representing overall operation sequence in an ignition apparatus for an internal combustion engine according to Embodiment 3 of the present invention.

FIG. 10 is a timing chart representing the operation sequence of the overall operation performed by an ignition apparatus for an internal combustion engine according to Embodiment 3. In FIG. 10, when, at the time t0, the switching means S1 is turned on (the switching means S4 may be either turned on or off), the current flows in the current path A illustrated in FIG. 9; thus, the secondary equivalent value of the energy storing coil current rapidly increases. In addition, the diode D3 has a function of preventing a reverse voltage from being applied to the switching means S4 during this period.

When, at the time t1, the switching means S1 is turned off and the switching means S4 is turned on, a current flows in the current path A1 indicated in FIG. 9, and hence the secondary equivalent value of the storing coil current gradually increases. At the time t2, the energy release period starts; the value of the current to be reached at the time t2 can be controlled at the time t0. That is to say, assuming that the time width from the time t0 to the time t2 is constant, the earlier the timing of the time t1 is, the smaller the current to be reached becomes, and the later the timing of the time t1 is, the larger the current to be reached becomes. By appropriately controlling the timing of the time t1, the value to be reached of the storing current can be made to coincide with the target current Itgt.

The time t1 can be determined in the following manner. When current flows in the current path A1 illustrated in FIG. 9, the gradient output equivalent value ILa of the coil current is given by Equation 10 below.

$$d(ILa)/dt=(Vin-Vdrop)/Le \quad \text{(Equation 10)}$$

where Vin, Vdrop, and Le are the voltage of the DC voltage source 1, the sum of voltage drops caused by the resistance components, the switching means, and the like in the current path A, and the total inductance of the energy storing coil 70, respectively.

Therefore, the current ILa, which is a function of the time t, during the period from the time t1 to the time t2 is represented as follows:

$$ILa(t)=Itgt+((Vin-Vdrop)/Le)\times(t-t2) \quad \text{(Equation 11)}$$

In other words, the current is made to coincide with ILa (t1) at the time t1; after that, the current reaches the target current Itgt at the time t2 in accordance with Equation 11.

By rewriting Equation 11 with respect to the input current IL1 of the energy storing coil 70, Equation 12 is given.

$$IL1(t)=[Itgt+\{(Vin-Vdrop)/Le\}\times(t-t2)]\times(Ne/Ne1) \quad \text{(Equation 12)}$$

Figure 11:
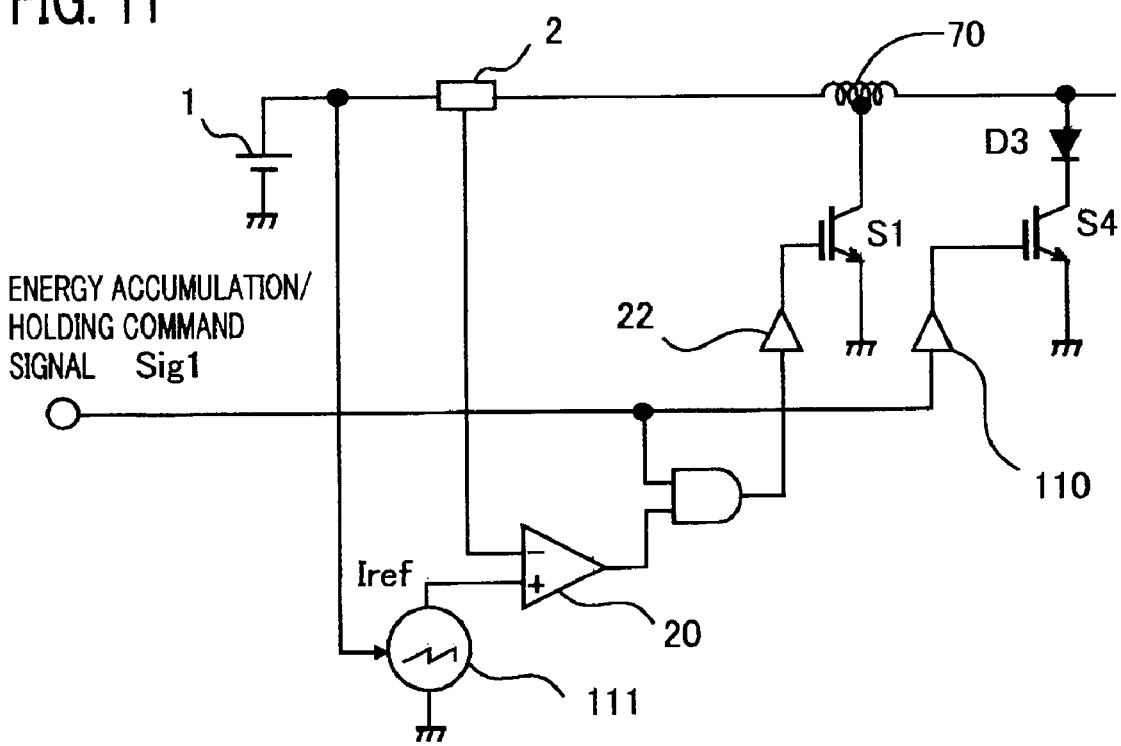
FIG. 11 is a circuit diagram illustrating a current control method in an ignition apparatus for an internal combustion engine according to Embodiment 3 of the present invention.

Accordingly, by utilizing the circuit illustrated in FIG. 11, a comparison current Iref to be compared with detected current value is made to have a slope-shaped waveform represented by Equation 13 below, so that, at the time t1, the input current IL1 of the energy storing coil 70 and the comparison current Iref to be compared with the detected current value coincide with each other, whereby the switching means S1 is turned off.

$$Iref(t)=[Itgt+\{(Vin-Vdrop)/Le\}\times(t-t2)]\times(Ne/Ne1) \quad \text{(Equation 13)}$$

After that, the output equivalent value of the coil current gradually increases in accordance with Equation 11 and reaches the target current Itgt at the time t2. In addition, in FIG. 11, reference numerals 110 and 111 denote a gate driver and a comparison current reference value generator, respectively.

During the energy storing period (the period from the time t3 to the time t5 and the same portions in the following recurrent periods) after the start of ignition, the same operation is performed as during the period from the time t0 to the time t1. Accordingly, Iref(t) illustrated in FIG. 11 is made to have a saw-tooth waveform like the broken line drawn superimposed on the waveform of IL1 in FIG. 10, so that the current value IL and the target current Itgt can always coincide with each other at a time when the energy storing period ends. Because Iref(t) is also a function of the input voltage Vin, the gradient of the saw-tooth waveform may be changed in accordance with the input voltage by detecting the input voltage in such a way as illustrated in FIG. 11.

As described above, in an ignition apparatus for an internal combustion engine according to Embodiment 3, it is possible to control the value to be reached of the energy storing current to be a predetermined value; therefore, as is the case with Embodiment 2, even in a wider input voltage range, the energy storing coil current and the current in the ignition plug can be kept to be predetermined values.

In Embodiment 1 or Embodiment 2, one terminal of the switching means S3 is connected with the hot (positive) terminal of the power source; in the case where, as a switching means, an IGB or an FET is utilized, it is required to form a gate waveform based on the hot terminal voltage as the reference voltage; therefore, the gate drive circuit becomes complicated. In contrast, in Embodiment 3, one terminal of each of the switching means S1 and S4 is connected with the ground potential; therefore, voltages with an amplitude of approximately 0 V through 15 V with respect to the ground potential may be fed to the gates, whereby the gate drive circuit can readily be configured.

Various modifications and alterations of this invention will be apparent to those skilled in the art without departing from the scope and spirit of this invention, and it should be understood that this is not limited to the illustrative embodiments set forth herein.

What is claimed is:

1. An ignition apparatus for an internal combustion engine comprising:

an energy storing coil one terminal of which is connected with a power source;

a first switching means connected with the other terminal of the energy storing coil;

an ignition coil one terminal of a primary winding of which is connected with the other terminal of the energy storing coil via a diode and a secondary winding of which is connected with an ignition plug;

a second switching means connected with the other terminal of the primary winding of the ignition coil;

a bypass means that is connected between both terminals of the energy storing coil and has a third switching means; and a control means that controls the first switching means, the second switching means, and the third switching means.

2. The ignition apparatus for an internal combustion engine according to claim 1, wherein the control means performs control in which the second switching means is recurrently turned on/off in order to apply a current with a positive-negative alternating polarity to the ignition plug, and during an off period of the second switching means, there exist a period in which the first switching means is turned on, thereby making a current flow in the energy storing coil so that energy is stored in the energy storing coil and a period in which the first switching means is turned off and the third switching means is turned on so that a current flowing in the energy storing coil is made to circulate in the bypass means.

3. The ignition apparatus for an internal combustion engine according to claim 2, further comprising a current detection means that detects a current flowing in the energy storing coil, wherein, when a current flowing the energy storing coil exceeds a first value, there is established a period in which the first switching means is turned off and the third switching means is turned on, and when the current flowing the energy storing coil becomes smaller than a second value, there is established a period in which the first switching means is turned on and the third switching means is turned on or turned off.

4. An ignition apparatus for an internal combustion engine comprising:

an energy storing coil one terminal of which is connected with a power source;

a first switching means connected with an intermediate outgoing line of the energy storing coil;

an ignition coil one terminal of a primary winding of which is connected with the other terminal of the energy storing coil via a diode and a secondary winding of which is connected with an ignition plug;

a second switching means connected with the other terminal of the primary winding of the ignition coil;

a bypass means that is connected between both terminals of the energy storing coil and has a third switching means; and a control means that controls the first switching means, the second switching means, and the third switching means.

5. The ignition apparatus for an internal combustion engine according to claim 4, wherein the control means performs control in which the second switching means is recurrently turned on/off in order to apply a current with a positive-negative alternating polarity to the ignition plug, and during an off period of the second switching means, there exist a period in which the first switching means is turned on, thereby making a current flow in the energy storing coil so that energy is stored in the energy storing coil and a period in which the first switching means is turned off and the third switching means is turned on so that a current flowing in the energy storing coil is made to circulate in the bypass means.

6. The ignition apparatus for an internal combustion engine according to claim 5, further comprising a current detection means that detects a current flowing in the energy storing coil, wherein, when a current flowing the energy storing coil exceeds a first value, there is established a period in which the first switching means is turned off and the third switching means is turned on, and when the current flowing the energy storing coil becomes smaller than a second value, there is established a period in which the first switching means is turned on and the third switching means is turned on or turned off.

7. An ignition apparatus for an internal combustion engine comprising:

an energy storing coil one terminal of which is connected with a power source;

a first switching means connected with an intermediate outgoing line of the energy storing coil;

an ignition coil one terminal of a primary winding of which is connected with the other terminal of the energy storing coil via a diode and a secondary winding of which is connected with an ignition plug;

a second switching means connected with the other terminal of the primary winding of the ignition coil;

a fourth switching means connected with the other terminal of the energy storing coil; and a control means that controls the first switching means, the second switching means, and the fourth switching means.

8. The ignition apparatus for an internal combustion engine according to claim 7, wherein the control means performs control in which the second switching means is recurrently turned on/off in order to apply a current with a positive-negative alternating polarity to the ignition plug, and during an off period of the second switching means, there exist a period in which the first switching means is turned on so that energy to be stored in the energy storing coil rapidly increases and a period in which the fourth switching means is turned on so that energy to be stored in the energy storing coil gradually increases.

* * * * *